US008495844B1

(12) United States Patent
Johnson, Sr.

(10) Patent No.: US 8,495,844 B1
(45) Date of Patent: Jul. 30, 2013

(54) SELF-ADJUSTING TRIM ASSEMBLY AT FLEXIBLE CEILING AND STATIONARY WALL JUNCTION

(71) Applicant: Thomas W Johnson, Sr., Woodstock, IL (US)

(72) Inventor: Thomas W Johnson, Sr., Woodstock, IL (US)

( * ) Notice: Subject to any disclaimer, the term of this patent is extended or adjusted under 35 U.S.C. 154(b) by 0 days.

(21) Appl. No.: 13/623,214

(22) Filed: Sep. 20, 2012

(51) Int. Cl.
*E04B 2/00* (2006.01)

(52) U.S. Cl.
USPC ..... 52/287.1; 52/238.1; 52/241; 52/288.1

(58) Field of Classification Search
USPC ..... 52/238.1, 241, 287.1, 288.1
See application file for complete search history.

(56) References Cited

U.S. PATENT DOCUMENTS

| | | | | | |
|---|---|---|---|---|---|
| 3,292,328 | A | * | 12/1966 | Darling et al. | 52/238.1 |
| 3,309,826 | A | * | 3/1967 | Zinn | 52/241 |
| 3,623,290 | A | * | 11/1971 | Downing, Jr. | 52/481.2 |
| 3,685,227 | A | * | 8/1972 | Grisard et al. | 52/242 |
| 3,722,163 | A | * | 3/1973 | Satkin et al. | 52/126.3 |
| 3,732,657 | A | * | 5/1973 | Nelsson | 52/241 |
| 3,998,027 | A | * | 12/1976 | Wendt et al. | 52/716.1 |
| 4,073,108 | A | * | 2/1978 | Williams | 52/238.1 |
| 4,087,944 | A | * | 5/1978 | Mecklenburg | 52/241 |
| 4,209,953 | A | * | 7/1980 | Wendt | 52/241 |
| 4,229,918 | A | * | 10/1980 | Delcroix | 52/242 |
| 4,361,994 | A | * | 12/1982 | Carver | 52/238.1 |
| 4,397,127 | A | * | 8/1983 | Mieyal | 52/241 |
| 4,461,135 | A | | 7/1984 | Anderson et al. | |
| 4,513,557 | A | * | 4/1985 | Wendt | 52/489.1 |
| 4,555,885 | A | | 12/1985 | Raymond et al. | |
| 4,575,979 | A | * | 3/1986 | Mariani | 52/241 |
| 4,642,957 | A | * | 2/1987 | Edwards | 52/242 |
| 4,798,035 | A | * | 1/1989 | Mitchell et al. | 52/281 |
| 4,881,352 | A | * | 11/1989 | Glockenstein | 52/239 |
| 4,887,401 | A | * | 12/1989 | Gioscia | 174/497 |
| 5,138,759 | A | * | 8/1992 | Gruetzmacher | 29/467 |
| 5,426,901 | A | | 6/1995 | Indracek | |
| 5,433,048 | A | | 7/1995 | Strasser | |
| 5,644,877 | A | * | 7/1997 | Wood | 52/241 |
| 5,755,066 | A | * | 5/1998 | Becker | 52/241 |
| 5,813,179 | A | * | 9/1998 | Koenig et al. | 52/255 |
| 5,822,935 | A | * | 10/1998 | Mitchell et al. | 52/239 |
| 6,128,877 | A | * | 10/2000 | Goodman et al. | 52/242 |
| 6,158,179 | A | * | 12/2000 | Ackerly et al. | 52/220.7 |
| 6,581,353 | B2 | | 6/2003 | Augustine | |
| 7,313,891 | B2 | * | 1/2008 | Showers | 52/267 |
| 7,451,574 | B2 | | 11/2008 | Spek | |
| 7,571,578 | B2 | * | 8/2009 | Moody et al. | 52/481.1 |
| 8,161,705 | B2 | * | 4/2012 | Pratt | 52/506.05 |
| 2006/0156679 | A1 | * | 7/2006 | Pierret | 52/698 |

* cited by examiner

*Primary Examiner* — Basil Katcheves
*Assistant Examiner* — Joshua Ihezie
(74) *Attorney, Agent, or Firm* — Patents and Licensing LLC; Daniel W Juffernbruch

(57) ABSTRACT

A self-adjusting trim assembly used at the junction of a wall and ceiling where the wall finishes are to remain stationary while the ceiling is expected to flex due to loads on ceiling structure and normal variations in the height of the supporting structures due to temperature, moisture, creep or other factors effecting the height of the support structures. This trim assembly has two interlocking components comprised of a retainer clip having a vertical back portion (1*a*), a horizontal projecting tongue (1*b*) and the interlocking hook portion (1*c*) and also of a trim strip having a horizontal top portion (2*a*), a vertical face portion (2*b*) and an interlocking hook portion (2*c*) with the vertical face portion of the trim strip designed to cover the gap between stationary wall finishes and a flexing ceiling while trim strip remains flush with the ceiling structure, thus leaving no unsightly gap.

20 Claims, 15 Drawing Sheets

Prior Art - Flat Tape

Prior Art - Finish bead & caulk

End view of 1

Rear view of 1

Front view of 1

End view of 2

Front view of 2

Rear view of 2

Preferred hook embodiment

Alternate hook embodiment

Alternate hook embodiment

Alternate hook embodiment cold weather view

SELF-ADJUSTING TRIM ASSEMBLY AT FLEXIBLE CEILING AND STATIONARY WALL JUNCTION

BACKGROUND OF THE INVENTIONS

1. Technical Field

The present inventions relate to the components and the procedure for installing a trim assembly at a wall and ceiling junction, and, more particularly, relates to a self-adjusting trim assembly designed to hide unsightly gaps at the junction between the top of a stationary wall finish and a ceiling expected to move.

2. Description of the Related Art

As construction techniques improved in recent years, free span concrete ceilings (poured or pre-cast spans devoid of columns and beams for intermediate support) have come into common usage. These free span structures are usually supported by interior walls or beams at the core of the building and by walls or beams at the exterior of the building.

Exterior support structures are frequently subject to temperature variances and forces not present on and around the interior (core) support structures. The dynamics involved with the exterior support structures cause them to expand, contract and move at different rates than the core structures, resulting in an anticipated flex or movement of the ceiling being supported. Therefore, non-supporting walls constructed between support structures have to be able to withstand the expected movement of the ceilings above them without sustaining damage. To prevent damage to non-supporting walls, deflection allowances are designed into those walls which include deflection framing components and a deflection gap between the top of the stationary wall finishes and the ceiling expected to move.

Initial usage of free span ceilings was primarily in commercial buildings where drop ceilings hid the necessary deflection gaps between stationary elements of a non-supporting wall and a flexing ceiling above. Often in commercial spaces, the area above the drop ceiling was used to house the required electrical feeds, plumbing, fire protection piping and the HVAC ducting. Those areas above dropped ceilings often exceeded a foot in height. When this construction method began to be used in residential building, providing a dropped ceiling below the structural ceiling proved to be impractical. Electrical systems, plumbing, fire protection and HVAC were relocated into the walls or soffits and the dropped ceilings were eliminated. Therefore, the structural ceiling became the finished ceiling. This resulted in eliminating the extra height on each floor required above dropped ceilings. In a multistory building, omitting these extra heights and the dropped ceilings added up to become a significant savings. However, when the structural ceiling became the finished ceiling, the unsightly deflection gap at the top of all the non-supporting walls became visible.

It is commonly desirable to provide aesthetically pleasing junctions or intersections between walls and ceilings. When an unsightly deflection gap is visible due to anticipated flexing of the ceiling, making an aesthetically pleasing junction at the deflection gap between the stationary wall finishes and the ceiling requires a necessary treatment or covering for the exposed deflection gap.

In construction where it is not necessary to have a deflection gap, there are numerous methods of treating the junction between a stationary wall and a stationary ceiling, such as taping the joint (applying a paper or mesh tape angle and finishing compounds to the wall and ceiling junction to make an unbroken finish between the ceiling and the wall) or by applying a standard molding like a crown molding, a cove molding, a square stock molding, a beam, etc. to enhance the appearance of the wall and ceiling junction. However, there are few options for treating the junction between a stationary wall finish and a ceiling that is expected to flex as the ceiling's support members expand, contract or move due normal conditions expected to effect the support structures.

The current, common options for treating a deflecting gap between a stationary wall finish and a slightly deflecting ceiling are flat taping the top of the stationary wall finish (applying paper or mesh tape and finishing compound on the wall surface only with the edge of the tape as close to the ceiling as possible without touching the ceiling) and/or caulking the gap between the top of the stationary wall finish and the ceiling.

The chief advantage to flat taping (as illustrated in prior art FIG. 1) is that imperfections on the top edge of the wall finish materials and the fire or sound caulking is partially hidden by the tape. However, the flat taping option is labor intensive, has a built in crack at the top and generally results in an even more unsightly junction once the ceiling deflects down on the top of the tape, which crushes and permanently deforms the tape. (Once the ceiling migrates back upward, an unsightly gap is more pronounced.)

The caulking option is also somewhat unsightly because slight defects (uneven cuts, jagged edges, etc.) at the top of the wall finish material are visible, dust and dirt tend to accumulate in the caulk space over time and the caulk tends to distort when the ceiling migrates in an upward or downward direction. To minimize the unsightly appearance at the edges of the wall finish materials, a finishing bead (as illustrated in prior art FIG. 2) was often installed at the top of the wall finish material and finished with finishing compound prior to the installation of the caulk. If a finish bead is used to define the top edge of the wall finish material and hide defects, the caulk method is more costly for materials and more labor intensive than flat taping. Being that caulk tends to loose it's elasticity and bonding propensity over time, it eventually tends to allow small cracks and gaps to develop. In many fire resistant and sound deadening wall designs, caulk is a necessary component. Therefore the cost of the materials and labor for the caulk itself was not a factor in determining the best finishing application for the wall and ceiling junction.

Many trims that could hide an unsightly wall/ceiling gap have been designed through the years past. However, known trims were not self-adjusting and do not accommodate flex in the ceilings. Most known existing trim systems attached to the surfaces of the stationary wall and the stationary ceiling. Many known improvements incorporated concealed brackets and fasteners. While the trims for treating the junction between a stationary wall and a stationary ceiling were functional in their designed environment, they all had one thing in common. They were designed to be applied to the surface of a finished wall and a ceiling and they did not accommodate flexing of the ceiling without distortion or system failure.

One example of a trim system used in stationary wall and ceiling applications was taught in U.S. Pat. No. 4,555,885 by Ronald P. Raymond and William C. Andric (1985). This demonstrated an extruded, trim system where the trim has a barbed protrusion that was designed to friction fit in the gap between the wall and ceiling materials with a nearly flat element of the trim extending onto the ceiling and another nearly flat element of the trim extending onto the wall (having a basic right angle shape visible) which covers the gap between the wall finish and the ceiling finish. Wide variations in the joint width, caused by the flex of the ceiling, challenges the reliability of this system. This system also does not leave sufficient room for fire or sound caulks which are required in many fire and sound rated wall assemblies.

Another example of a trim system used in stationary wall and ceiling applications was taught in U.S. Pat. No. 4,461,135 by Dallas A. Anderson and Harlan J. Grayden (1984). This system is a 2 piece system of a plurality of slip-on clips and a trim piece that pushes onto the clips. This system functions in a manner similar to a slip-on J bead (a common edge treatment for drywall and other panel materials). This system attaches to the top of the finish panel for the wall system. This combination of clips and a trim piece is then manually adjusted after installation by sliding the trim into position immediately adjacent to the ceiling. Because this system is not self-adjusting, once the ceiling flexes in it's expected up and down migrations, a pronounced gap is developed. Being that this system is not self-adjusting, the trim would require periodic adjustment after installation.

A different approach to maintaining a pleasing appearance at the wall/ceiling junction was demonstrated in U.S. Pat. No. 6,581,353 by Ronald J. Augustine (2001), whereby the flexing of the ceiling is compensated through suspending the entire wall construction from the ceiling. This option creates a static wall/ceiling junction which can be finished using any existing finish or stationary trim system. The necessary gap that allows for flexing of the ceiling is just above the floor, with the deflection gap hidden by the baseboard. Lateral support for this wall construction system is at the bottom of the wall and is provided by using the sliding component of this invention. Drawbacks to this type of construction are the extremely high material, labor and fastener costs, the relative instability of the partitions at the base and the inability of this design to meet most fire and sound resistance ratings.

Numerous crown molding designs such as those shown in U.S. Pat. Nos. 5,426,901 by Jaroslav Indracek (1995), 5,433,048 by Jean P. Strasser (1995), 4,642,957 by Troy C. Edwards (1987) and 7,451,574 by Micheal Timothey Spek (2008) include many improvements in reducing costs of installation and material costs for use at the junction of a stationary wall and a stationary ceiling. While many of these designs incorporate improvements such as brackets and preformed corners to help hide fasteners and facilitate faster installations, the chief drawback to all these systems is that they were not designed for use at a junction between a stationary wall finish and a flexible ceiling.

SUMMARY OF THE INVENTIONS

This invention is a self-adjusting trim system in all it's present and future embodiments that can be used in any building where the ceilings are expected to flex due to the inherent properties of the construction materials and support structures while the wall finishes abutting the ceilings are expected to remain stationary. To allow for the expected movement of the ceiling an unsightly gap must exist between the top of the stationary wall finishes and the flexing ceiling. Most often, the ceiling system expected to exhibit some amount of flex would be made of poured concrete or pre-cast concrete that spans from an inside (core) support wall to an outside (exterior) support wall. This invention is designed to have no adverse effect on the fire and/or sound ratings of the wall and ceiling systems. A key benefit of this system, in addition to solving the problem of providing an aesthetically pleasing finish to the stationary wall and flexing ceiling junction, is that this system of components and the installation procedure is very economical.

BRIEF DESCRIPTION OF THE DRAWINGS

The present inventions are illustrated by way of example and are not limited by the accompanying figures, in which like references indicate similar elements. Elements in the figures are illustrated for simplicity and clarity and have not necessarily been drawn to scale.

The details of the embodiments will be more readily understood from the following detailed description when read in conjunction with the accompanying drawings wherein.

DETAILED DESCRIPTION OF THE PREFERRED EMBODIMENTS

Figure 1:
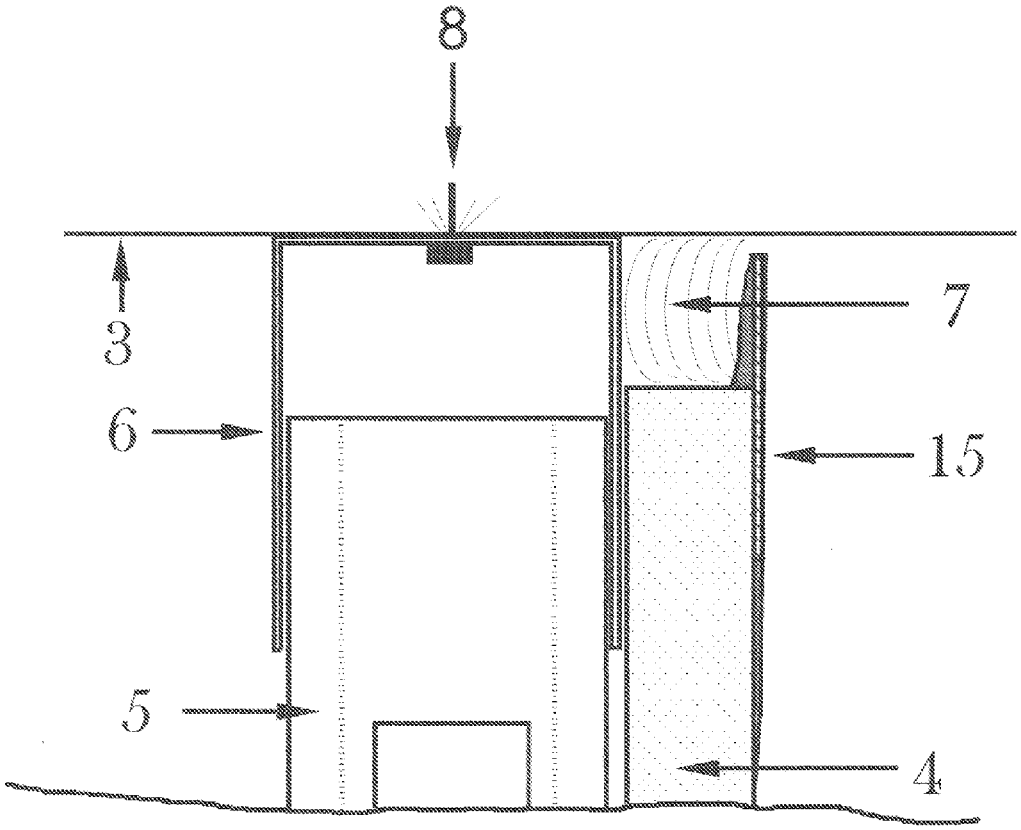
FIG. 1 illustrates a cutaway end view of the prior art of flat taping, a common way of hiding the necessary gap between the wall finish and the ceiling.

FIG. 1 shows the common, aesthetic treatment of the necessary gap between the top of the stationary wall finish and the ceiling that is expected to flex due to expansion, contraction and other anticipated movement of the support walls at each end of the ceilings. Note that the paper tape and finishing compound 15 is applied to the top edge of the wall finish 4 with a gap between the tape and compound 15 and the ceiling 3 above. Also shown are the framing components of this typical construction designed to allow for ceiling flex (vertical framing component 5 in a deflection or slip track 6), and caulk 7 in the gap between the top of the wall finish 4 and the ceiling 3. The problem with this construction results during the anticipated upward and downward travel of the ceiling 3, which crushes the top of the flat tape and compound 15 and then exaggerates the gap at the top of the tape when the ceiling 3 flexes in an upward direction. This treatment of the wall finish and ceiling gap is labor intensive and costly, but doesn't result in a permanent acceptable finish. A plurality of vertical framing components is usually contained within a wall assembly to provide the structure for the wall finishes to be used. In an assembly where the ceiling is expected to flex, the vertical framing components are expected to slide within the vertical legs of the deflection track without interfering with the up and down movement of the ceiling. For this reason, the vertical framing components and attached wall finishes are not attached to the deflection track. A deflection track is a framing component that is U-shaped with a vertical leg on each side that provides lateral stability to the wall framing assembly while concurrently allowing the ceiling to which the horizontal portion is attached to move without crushing the vertical wall framing components of the assembly.

Figure 2:
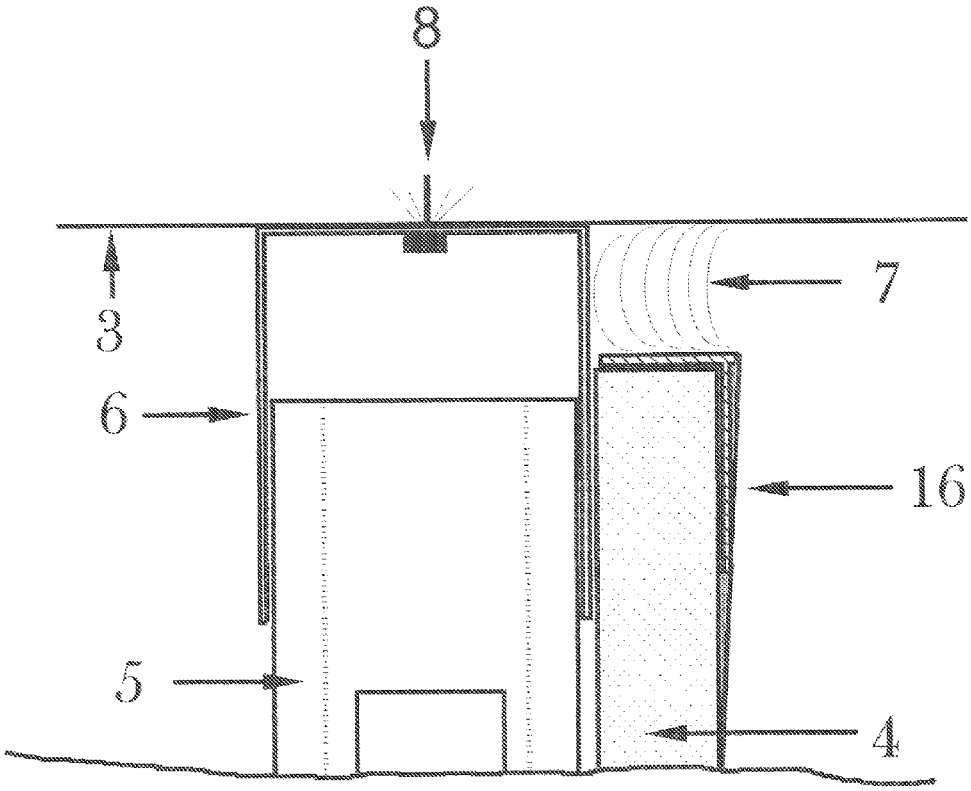
FIG. 2 shows a cutaway end view of the prior art of exposed caulking in the exposed gap, another common option where a finish bead and compound are installed on the top of the wall finish to establish a straight line defining the necessary gap between the wall finish and the ceiling which is then filled with caulk.

FIG. 2 shows another common aesthetic treatment of the necessary gap between the top of the stationary wall finish and the ceiling that is expected to flex. This treatment shows a finishing bead with taping compound 16 at the top of the wall finish 4. The necessary expansion gap between the top of the wall finish 4 and the ceiling 3 is then filled with caulk 7. This caulk filled gap is always noticeable. As the ceiling 3 flexes, the caulk 7 deforms and eventually allows cracks to develop between the caulk and the ceiling 3. Due to the uneven texture and shape of the caulk 7, dust and dirt tends to accumulate in the caulk joint. This treatment is also labor intensive and costly without resulting in a permanent, aesthetically pleasing finish.

Figure 3:
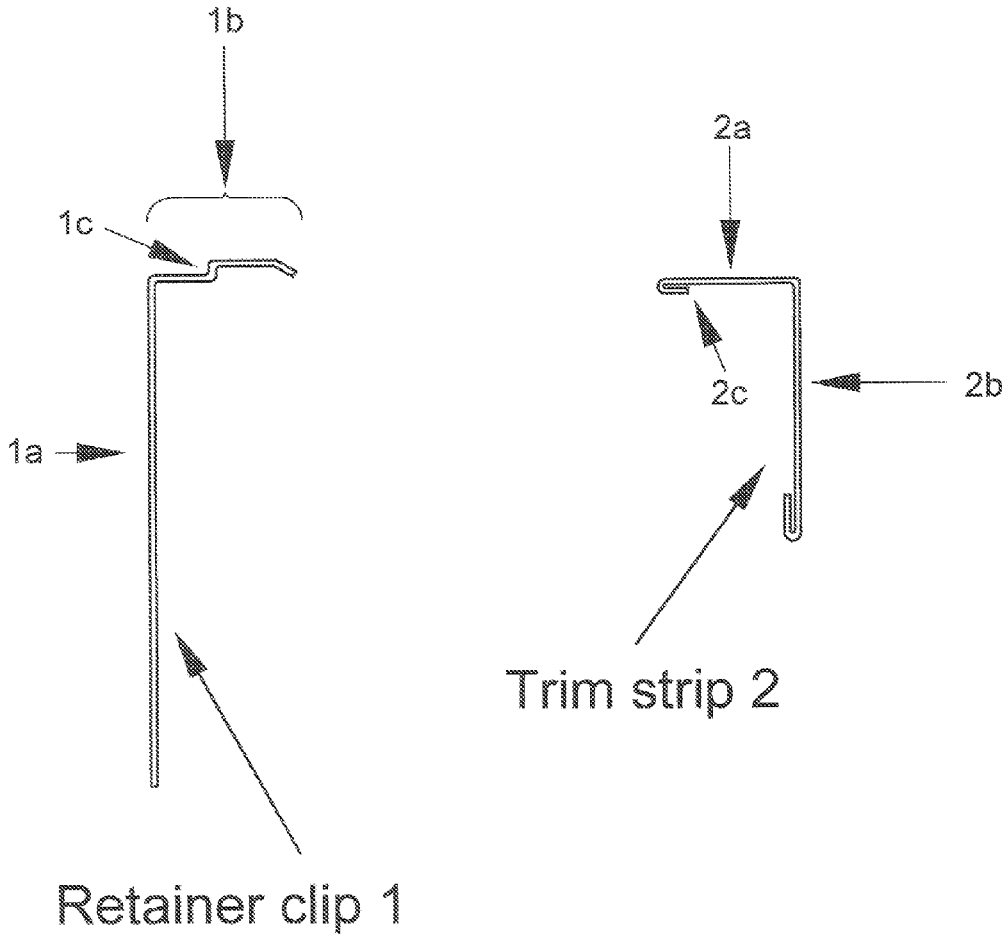
FIG. 3 illustrates a side view of the basic components upon which this invention is based.
Figure 7:
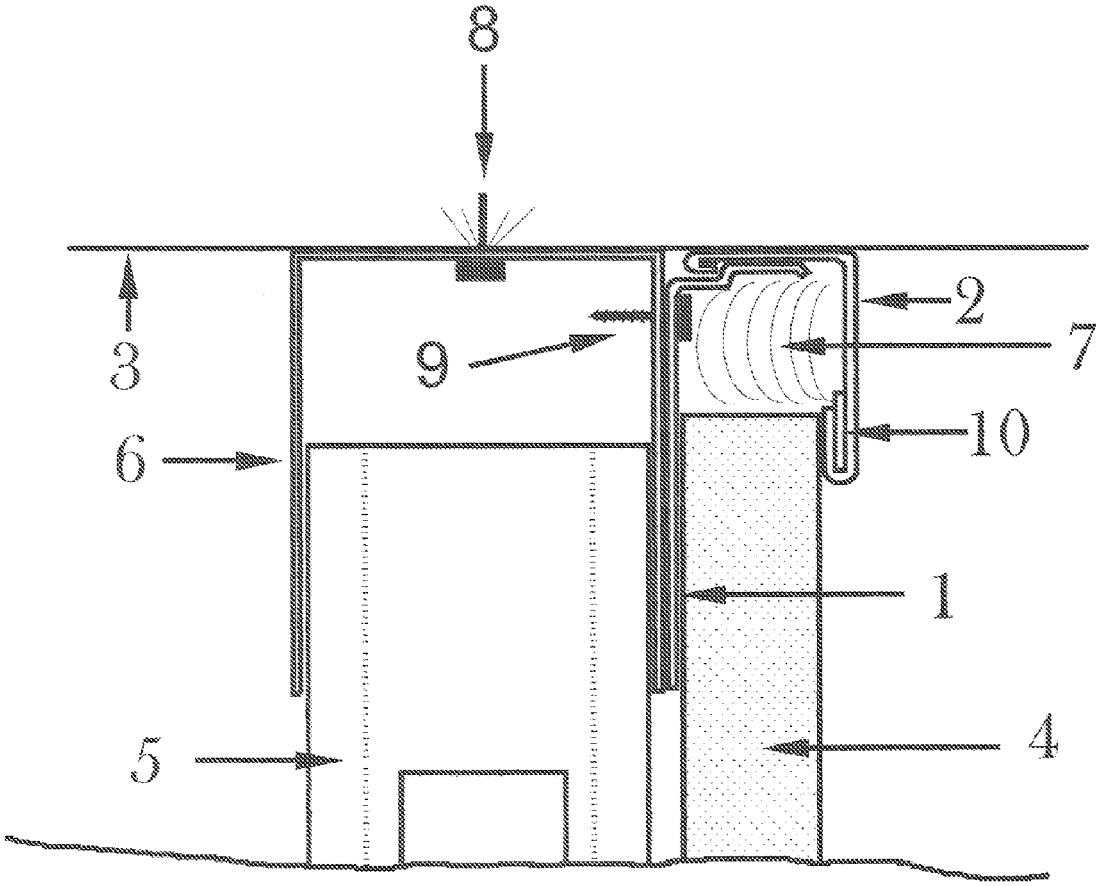
FIG. 7 illustrates a cutaway end view of the components of the basic trim system installed in a typical wall construction.
Figure 8:
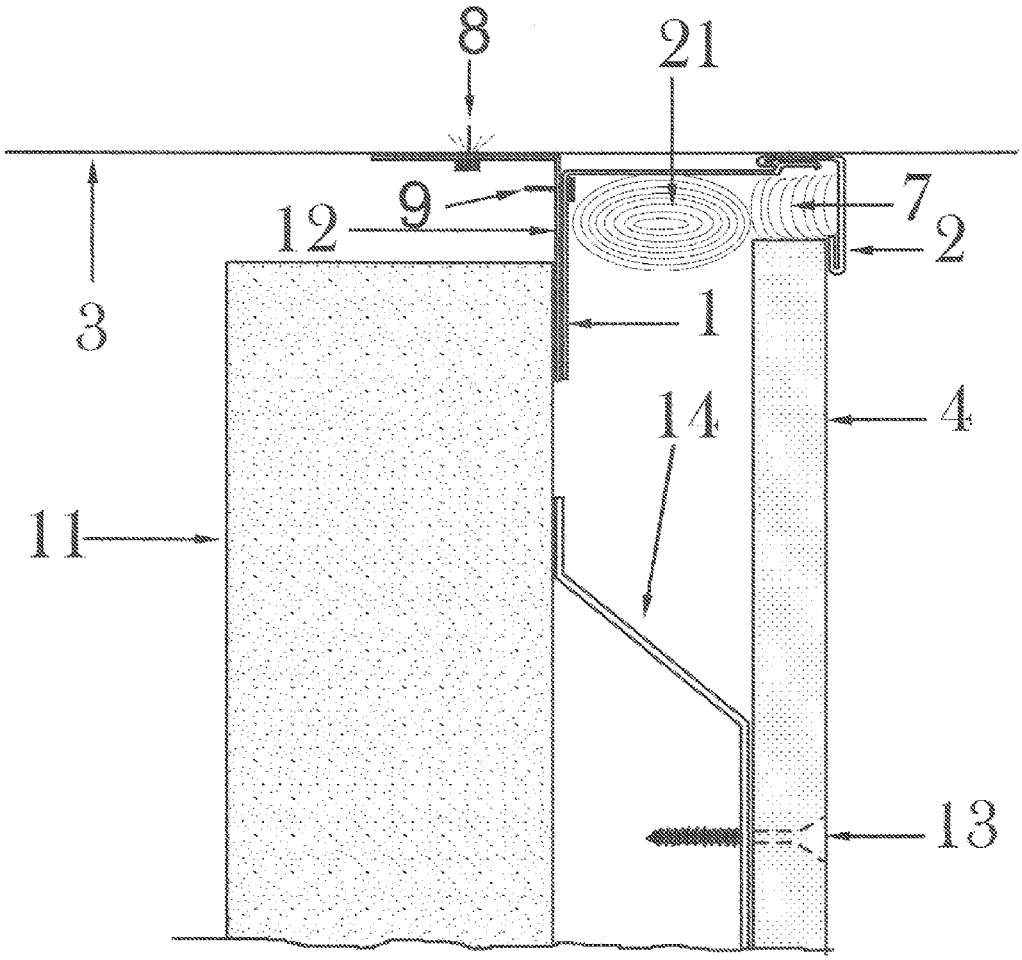
FIG. 8 illustrates a cutaway end view of the components of the basic trim system with the Retainer Clip sized to accommodate the greater distance of the wall finish from the wall framing installed in another type of typical wall construction.
Figure 22:
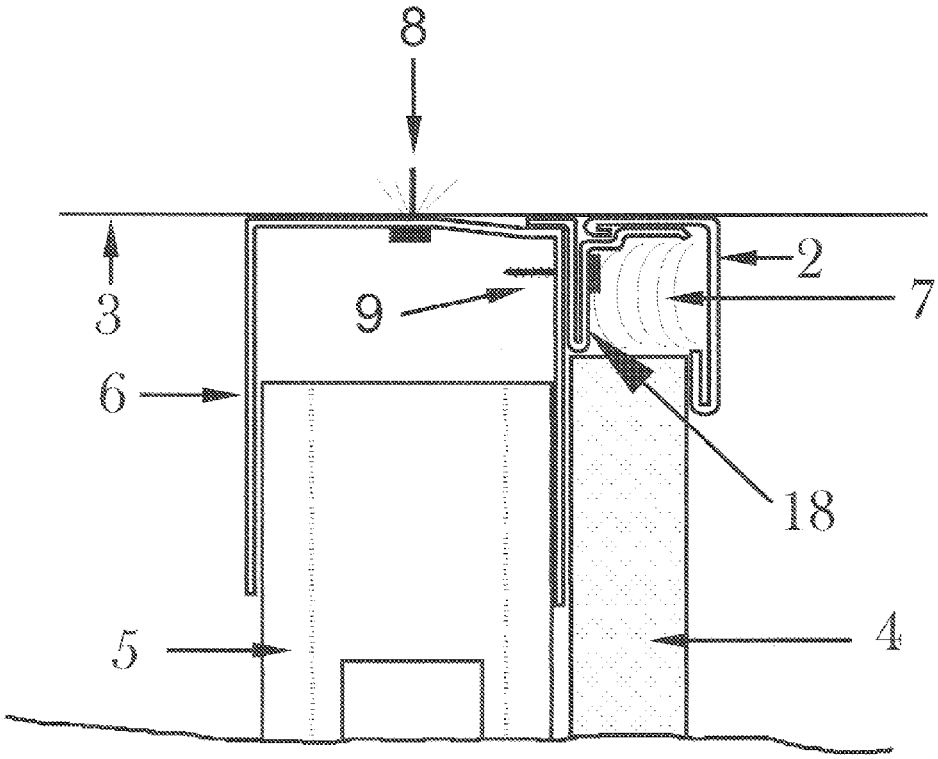
FIG. 22 illustrates a cutaway end view of the components of the basic trim system installed in a typical retrogressive wall construction using an alternate Retainer Clip designed to be installed after wall finishes have been previously installed.

FIG. 3 is a side view of the primary components (Retainer Clip 1 and Trim Strip 2) of this invention (also shown during typical usage in FIGS. 7 and 8 and in special usage in FIG. 22). This invention is essentially; a 2-piece combination of components and the method of installation that enables the Trim Strip 2 of this combination to hide the essential gap that exists in a typical wall/ceiling junction where the wall finishes 4 are stationary and the ceiling construction 3 is designed to flex in response to changes in support structure heights. The following were considerations used in designing this invention:

1. Material Considerations.

In finish systems where it is necessary to maintain fire ratings, metal trim components could be preferable to other known materials such as plastic trim components because metal components tend not to contribute to combustion and do not omit the toxic fumes often generated by melting or combustion of other types of materials. Being the trim component of this system is a visible finish element of the wall construction, the trim component needs to be pre-primed or pre-finished, mold resistant, moisture resistant, resistant to distortion caused by building movement and rust and corrosion resistant. While the retainer clips are not visible after complete system installation, they still need to be resistant to distortion caused by building movement and rust and corrosion resistant. Materials and fabrication of system components need to be affordable. The Retainer Clip and the Trim Strip are preferably each formed from one piece of metal or other material to make the manufacture or installation more affordable.

2. Ease of Installation.

The Retainer Clips 1 for this system are small and lightweight, so that they are easily carried by the installer in a carpenter's pouch or nail apron. Installation of the Retainer Clip 1 is by screw attaching with framing screws 9 to deflection track 6 or a deflection angle 12 in a wall assembly while holding the Retainer Clip 1 up to the ceiling 3. To make installation as fast as possible, spacing of clips need only be placed 2" off the ends of each wall and placed approximately 2 to 4' on center between the ends (insuring that the framing screws 9 do not engage the vertical framing component 5 portion of the framing so that movement of the deflection track 6 or deflection angle 12 is not inhibited). Exact spacing of Retainer Clips 1 is not required (except at joints of the Trim Strips 2 where the wall length exceeds the standard length of trim components 2). Therefore, installation time for installing Retainer Clips 1 is minimized. The system requires the Trim Strip 2 to be snapped into the Retainer Clips 1 after being measured and cut for length. Where Trim Strips 2 intersect each other or where they are required to abut each other in long wall instances, they have square cut ends during manufacture and are able to be abutted without requiring mitering, special connecting pieces or special cuts. In special instances where it is necessary to maintain alignment where slight deviations in the wall surfaces tend to misalign the butt joints of the Trim Strips 2, a Joint Tab 10 (shown in FIG. 3) may be used. The cost to install these components is off-set by the elimination of flat-taping or the taping and finishing of a tape bead at the top of the wall finish as shown in FIGS. 1 and 2, making this system extremely cost efficient.

3. Compatibility with Other Wall and Ceiling Components.

This system does not hinder in any way, the installation or performance of the framing or finishes in constructing the wall. In new construction, it does, however require the installation of the Retainer Clips 1 between the wall framing and the installation of the wall finishes. The Trim Strip 2 is installed after the wall finishes are installed. In instances where the walls were finished previously and where it is desired to provide this self-adjusting trim system at a later date, Retainer Clip 18 may be substituted for the basic system Retainer Clip 1 so that the existing wall finishes do not need to be disturbed in order to install this system. The Trim Strip 2 is then installed in the normal manner. Where fire caulk is a necessary component of a fire rated wall system, this molding system allows for the complete, economical installation of the caulk. This system allows for the complete, economical installation of wall framing, wall finishes and caulk, where specified, without slowing any operation or without hindering the operation of any system.

Figure 4:
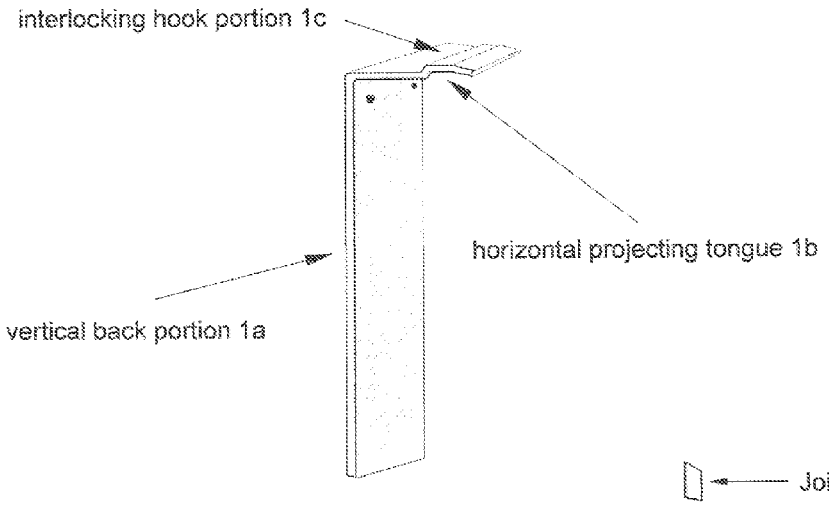
FIG. 4 is an isometric view of the Retainer Clip component of the basic system which is essential to this invention.

FIG. 4 is an isometric view of Retainer Clip 1 which shows the vertical back portion of the clip 1*a*, the horizontal, projecting tongue 1*b* and the location of the interlocking hook is portion 1*c*. The horizontal tongue portion 1*b* of the Retainer Clip 1 acts as a spring. The horizontal tongue portion 1*b* of the Retainer Clip 1 is resilient enough to the degree that the interlocking hook 2*c* of the horizontal top portion 2*a* of the L-shaped Trim Strip can fit between the ceiling 3 and the horizontal projecting tongue 1*b* of the Retainer Clip 1 during installation until the interlocking hook 2*c* snaps into place and locks into interlocking hook 1*c* of the Retainer Clip 1. The resiliency of the Retainer Clip 1 causes a vertical force against the Trim Strip 2 towards the ceiling 3 thereafter. In certain embodiments made from some metals, Retainer Clips 1 may be made resilient to act like a spring when heat treated after bending. Some materials such as brass or plastics may not require heat treating to provide optimal resiliency due to inherent physical properties. (See FIGS. 15 through 18 for hook embodiments.) The vertical back portion of the retainer clip could range from ¼" to 3" wide and up to 4" high. The horizontal projecting tongue portion of the Retainer Clip could range from ¼" to 3" wide and from ½" to 3" deep.

Figure 5:
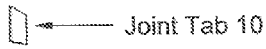
FIG. 5 is an isometric view of a Joint Tab which is an optional component for aligning abutted trim components of the basic system.

FIG. 5 is an isometric view of a Joint Tab 10 that is an optional connector used to align two abutting Trim Strip 2 pieces. This connecting tab is inserted into the end at the upturned portion of each Trim Strip 2 at the joint where each butts to align the components.

Figure 6:
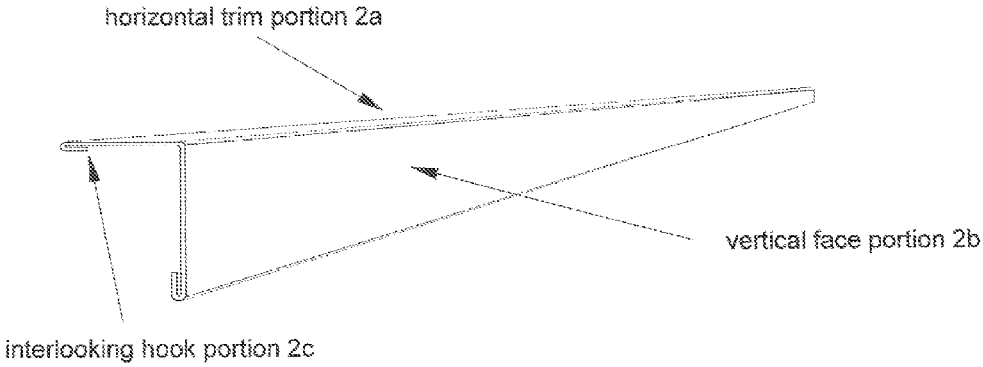
FIG. 6 is an isometric view of a basic trim component, hereinafter referred to as the Trim Strip of the basic system which covers gaps between wall surfaces and ceiling surfaces.

FIG. 6 is an isometric view of a primary Trim Strip 2, showing the horizontal, top portion 2*a*, the vertical face portion 2*b* and the hook portion 2*c*. The Trim Strip 2 is an elongated member formed of a resilient material with an L-shape in the cross section. The face portion 2*b* is the only exposed portion of the trim system when properly installed. The top portion 2*a* has the interlocking hook 2*c* at the end which locks into the Retainer Clip 1 at the interlocking hook portion 1*c*. The Trim Strip 2 is resilient enough to the degree that combined with the location of the interlocking hooks on the Retainer Clip 1 and the Trim Strip 2, the resiliency of the Trim Strip 2 causes a horizontal force to press the lower end of the face portion 2*b* of the Trim Strip 2 against the wall finish 4. In certain embodiments made from some metals, Trim Strips 2 may be made resilient to act like a spring when heat treated after bending. Some materials may not require heat treating to provide optimal resiliency due to inherent physical properties. The face portion 2*b* has a small portion that is turned toward the wall finish 4 and up to form a stand-off that rides on the wall finish 4 without damaging the finish of the wall after installation. The face portion 2*b* could range from ½" to 2" high with the horizontal top portion just long enough to engage and interlock with the Retainer Clip 1. The length of the Trim Strip 2 is expected to range from 10 to 12' in standard lengths.

FIG. 7 shows a typical wall framing assembly of a deflection track 6 attached to the ceiling or deck construction 3 with a concrete pin or screw 8 and a vertical framing component 5. The vertical framing component is usually a wood or metal stud and extends from the floor to within ½" of the ceiling. Also shown are a wall finish 4, caulk 7 and in the embodiments containing the Retainer Clip 1 and Trim Strip 2. Also shown is the optional Joint Tab 10. Wall finishes can be drywall, plaster, stone, brick, paneling, stucco, acoustical panels or any other synthetic material. While most assemblies use wood or metal framing studs, other materials could be used to serve as the vertical framing component such as concrete block, clay tile, poured concrete, etc.

An installation procedure is as follows: As shown, after the wall framing is installed, attach the Retainer Clip 1 is anchored to the deflection track. A preferred example of how to anchor the Retainer Clip 1 to the deflection track 6 is with a framing screw 9. After the wall finish 4 is attached to the vertical framing component 5 of the framing assembly (but not to the deflection track 6 or Retainer Clip 1) and the caulk is installed, if required for sound or fire ratings, install the Trim Strip 2 component of the invention by forcing the horizontal portion of the Trim Strip 2 between the top of the Retainer Clip 1 and the ceiling construction 3 until it snaps into the Retainer Clip 1 hook. Once installed, the Trim Strip 2 is held tightly to the ceiling by the shape of and the tension exerted by the Retainer Clip 1. The relative position of the hooks on the Retainer Clip 1 and the Trim Strip 2 is engineered to provide a slight amount of lateral force on the face of the Trim Strip 2 which in conjunction with the resilient properties of the Trim Strip 2, holds it tight to the face of the wall finish 4. This illustration shows a finish on one side of the wall framing only. However, finishes and the trim system would commonly be used on one or both sides of the framing in normal construction.

FIG. 8 shows another typical wall construction of a wall structure or framing system 11 (concrete block illustrated in this example, but it could be wood framing, metal framing, poured concrete or any other common construction system), a deflection angle 12 attached to the ceiling construction 3 by pin or screw 8, wall furring 14 (resilient furring channel for this example) attached to the wall structure or wall framing, a wall finish 4 attached to the wall furring 14 with screw 13, caulking backer rod 21 (used to minimize the amount of caulk required), caulk 7 and the embodiments with the Retainer Clip 1 and the Trim Strip 2. This example of the usage of this invention shows that the Retainer Clip 1 needs to be available with various tongue sizes to accommodate the variety of expected wall finish systems. Being that Retainer Clips 1 are much more inexpensive to manufacture in a variety of sizes than a variety of Trim Strips 2, the variety of Retainer Clips 1 option is currently preferred. This illustration shows a finish on one side of the wall framing only. However, finishes and the trim system would commonly be used on one or both sides of the framing in normal construction. A deflection angle serves the same function as a deflection track (previously described herein) but is usually used on one side only. Sometimes a deflection angle could be used on both sides of a wall structure where a deflection track is impractical. One or both of the deflection angle or the deflection track can be referred to by the generic term deflection component. Wall furring is used in some wall assemblies to improve the sound reduction coefficient of the entire assembly by adding an air space between the wall framing and the wall finishes. Wall furring is also used in some assemblies to provide backing for easier attachment of the wall finishes.

Figure 9:
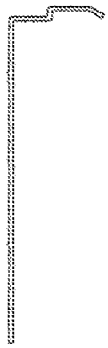
FIG. 9 is an end view of the Retainer Clip component in just one of many optional sizes.
Figure 10:
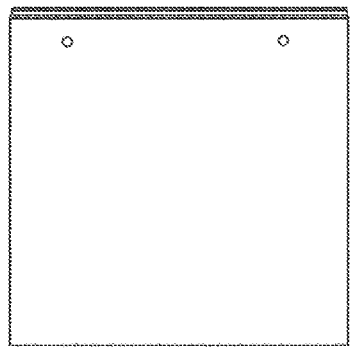
FIG. 10 is a rear view of the Retainer Clip component.
Figure 11:
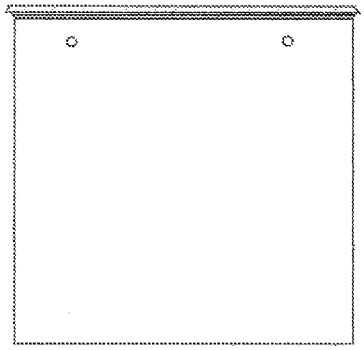
FIG. 11 is a front view of the Retainer Clip component.

FIGS. 9, 10 and 11 are end, rear and front views of the Retainer Clip 1. While the vertical portion of the Retainer Clip 1*a* is expected to remain approximately the same size through all embodiments, the tongue portion 1*b* will be sized to accommodate various widths of wall finish treatments. Normal wall finish thicknesses in the United States are expected to range from ½" to 1¾". International finish thicknesses are expected to have a similar range. Special sized tongue portions 1*b* should be made available on a special order basis.

Figure 12:
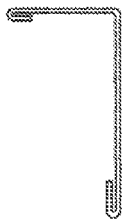
FIG. 12 is an end view of an embodiment of the Trim Strip component.
Figure 13:
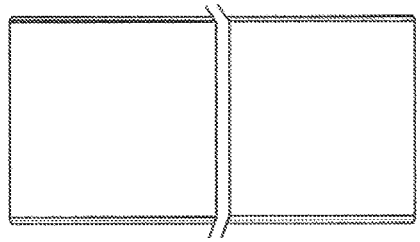
FIG. 13 is a front view of the Trim Strip component.
Figure 14:
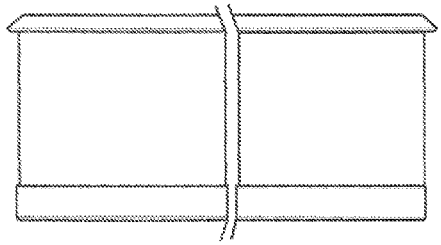
FIG. 14 is a rear view of the Trim Strip component.

FIGS. 12, 13 and 14 are end, rear and front views of the primary Trim Strip 2. The vertical and horizontal dimensions for the Trim Strip 2 are expected to be a standard size in the embodiments. The horizontal portion has a hook 2*c* at the engagement side with the Retainer Clip 1. The vertical side of the Trim Strip 2 is the portion that is faced into the room after installation and is the portion that covers the gap behind.

Figure 15:
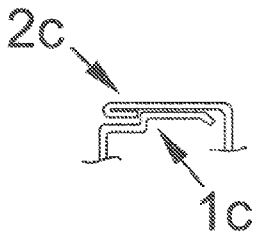
FIG. 15 is an end view of the embodiments for a hook design for both the Retainer Clip and the Trim Strip component of the basic system.
Figure 16:
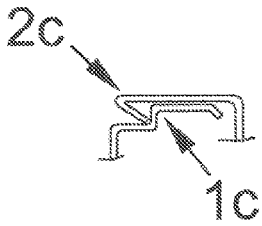
FIG. 16 is an end view of an alternate hook design for both the Retainer Clip and the Trim Strip component of the basic system.
Figure 17:
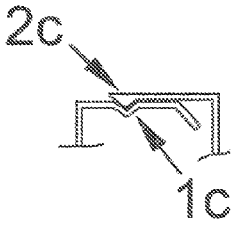
FIG. 17 is an end view of an alternate hook design for both the Retainer Clip and the Trim Strip component of the basic system.
Figure 18:
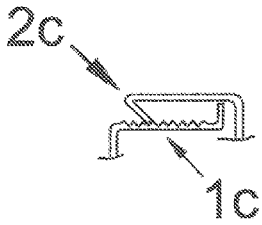
FIG. 18 is an end view of an alternate hook design for both the Retainer Clip and the Trim Strip component of the basic system.

FIGS. 15 through 18 show possible options for the hook on both the Retainer Clip 1 and the Trim Strip 2. As shown, FIG. 15 is the preferred hook option.

Figure 19:
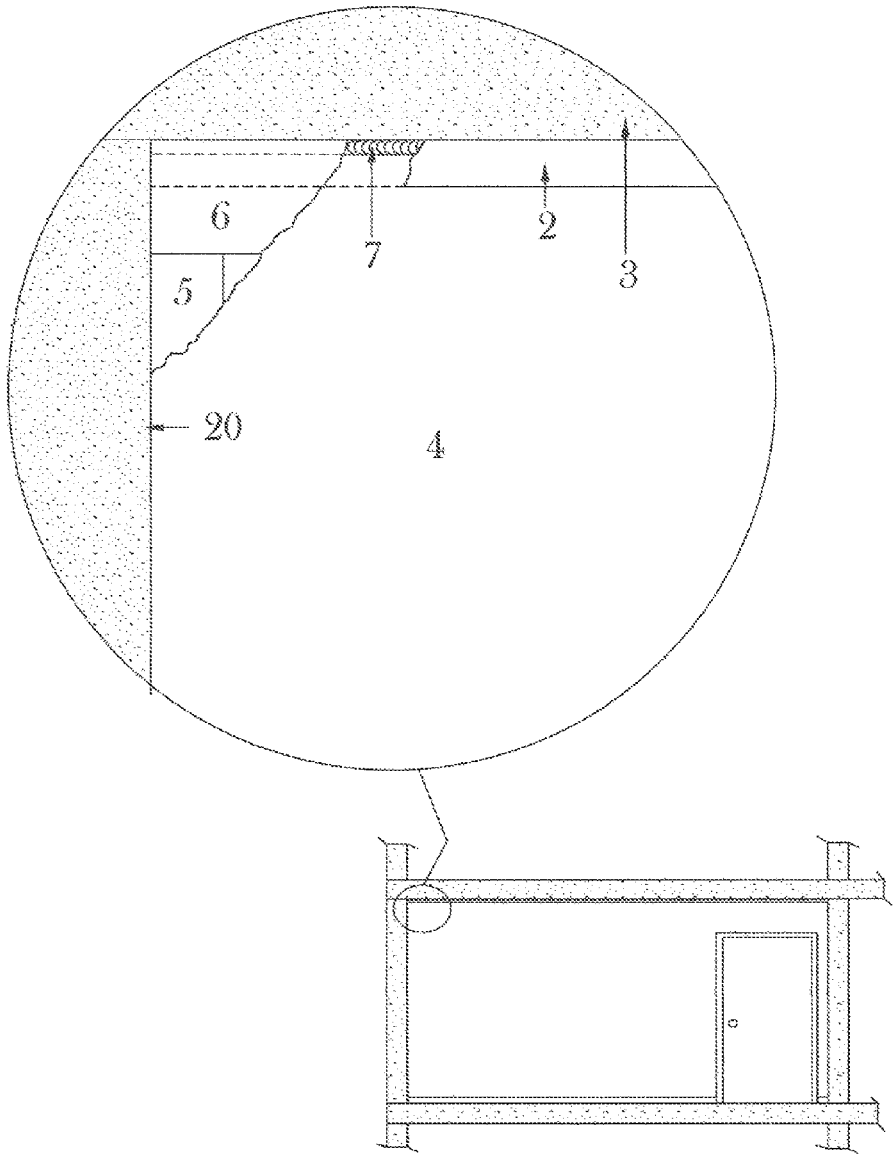
FIG. 19 illustrates a view of a corner in a room with the trim system installed and of the conditions behind properly installed trim after initial installation.

FIG. 19 illustrates a typical cross-section view of a portion of a multi-story concrete building having concrete walls and ceilings or decks. The blow-up shows an expanded corner of a wall when looking from the room side with the Stationary Wall and Flexible Ceiling Trim System installed. The blow-up shows a cut-away of the Trim Strip 2 (Retainer Clip 1 not shown) to show the top of the wall finish 4 and the resulting, engineered gap filled with caulk 7. A typical deflection of a ceiling is expected to flex as much as about 0.375 inches or up to about 0.4% of the room height depending on temperature variations and support structure material properties. Further into the corner, another cut-away shows the framing (deflection track 6 and vertical framing component 5) behind the wall finish 4 and the caulk 7. Also shown is the flexible ceiling 3 and the building exterior wall 20 support structure (which is subject to wide temperature variations causing the support structure to shrink and expand as the outside temperature varies).

Figure 20:
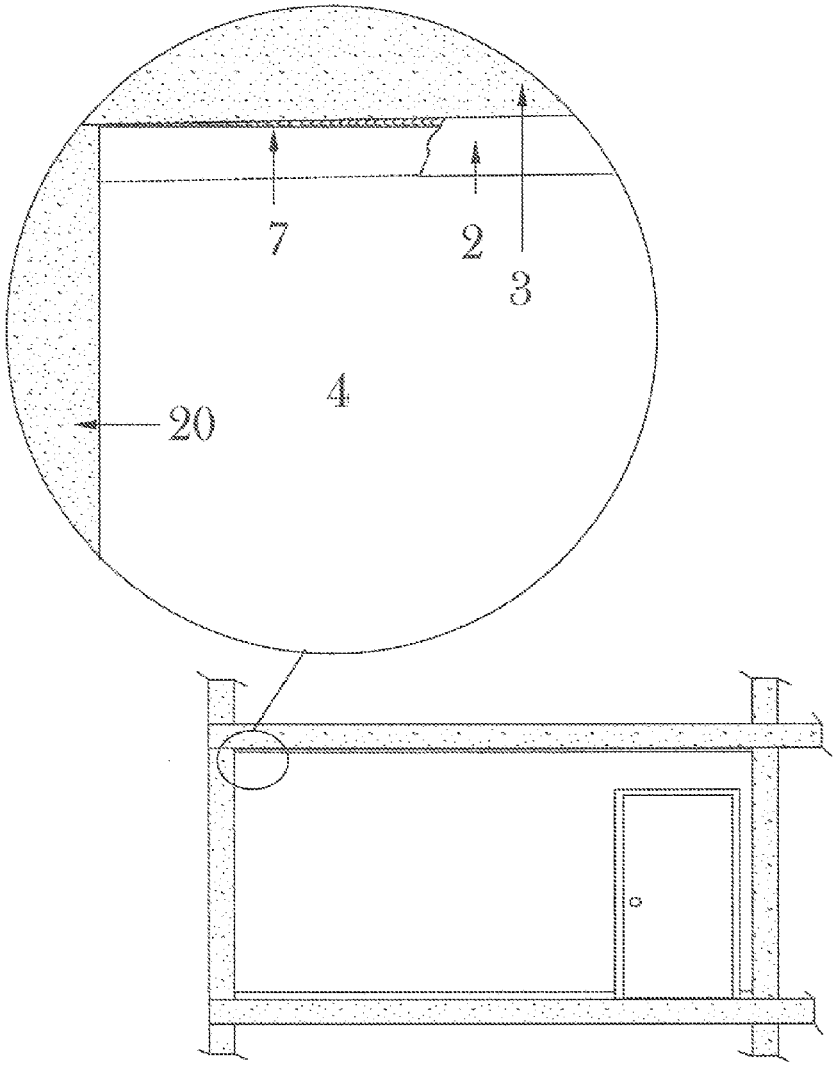
FIG. 20 illustrates a view of a corner in a room with the trim system installed and of the conditions behind the properly installed trim during cold weather exterior wall shrinkage when the designed gap between the static wall finish and the flex ceiling is reduced.

FIG. 20 illustrates a typical cross-section view of a portion of a multi-story concrete building having concrete walls and ceilings or decks during cold weather. The blow-up shows a corner of a wall when looking from the room side with the Stationary Wall and Flexible Ceiling Trim System installed. The cut-away on this drawing shows the effect on the engineered gap between the top of the stationary wall finish 4 and the flexing ceiling 3. Note that the caulk 7 in the gap is collapsed when the outside wall support structure 20 shrinks due to extremely cold temperatures. Also note that during this extreme temperature event, the Trim Strip 2 remains in tight contact with the ceiling and completely hides the gap distortion behind.

Figure 21:
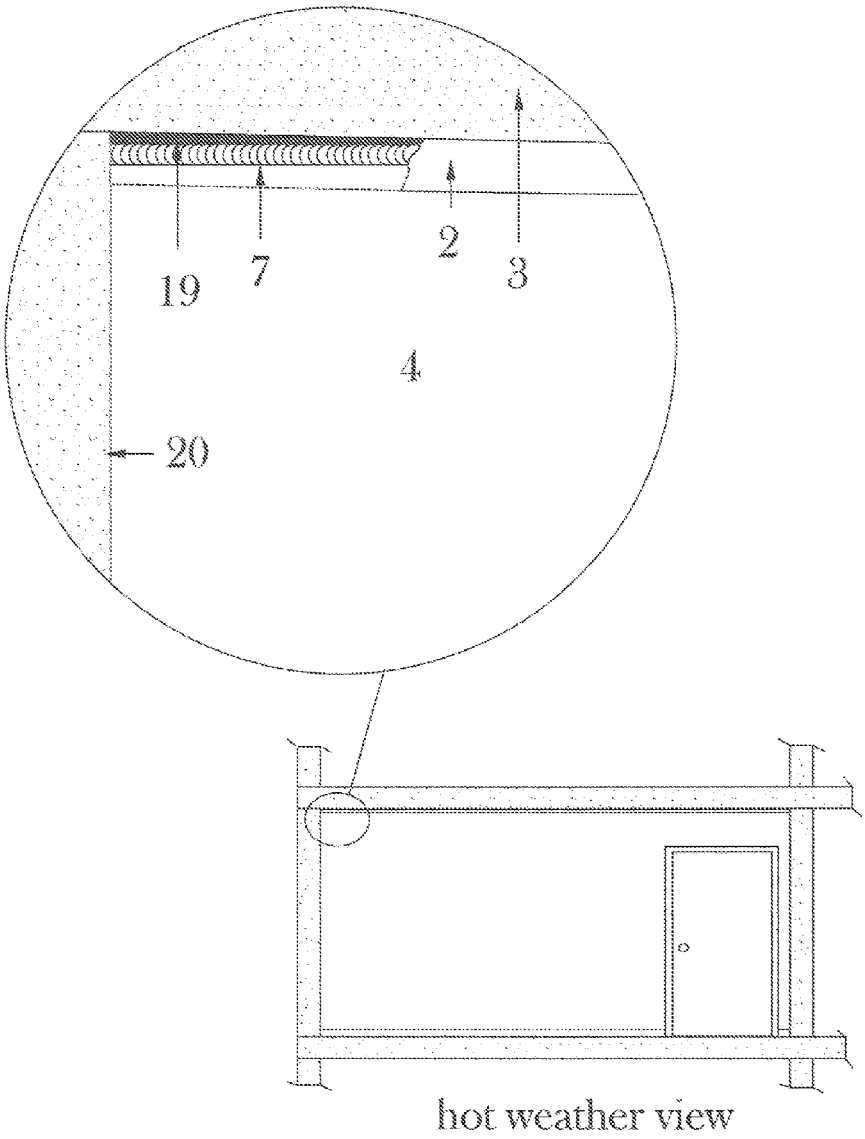
FIG. 21 illustrates a view of a corner in a room with the trim system installed and of the conditions behind the properly installed trim during hot weather exterior wall expansion when the designed gap between the static wall finish and the flex ceiling is expanded.

FIG. 21 illustrates a typical cross-section view of a portion of a multi-story concrete building having concrete walls and ceilings or decks during extremely hot weather. The blow-up shows a corner of a wall when looking from the room side with the Stationary Wall and Flexible Ceiling Trim System installed. The cut-away on this drawing shows the effect on the engineered gap between the top of the stationary wall finish 4 and the flexing ceiling 3. Note that the caulk 7 in the gap is somewhat recovered (after being crushed during cold weather) when the outside wall support structure 20 expands due to extremely hot outside temperatures. However, an exaggeration 19 of the gap tends to develop between the top of the caulk 7 and the ceiling 3 as the total gap continues to grow due to the expanding of the exterior wall support structure 20. Also note that during this extreme temperature event, the Trim Strip 2 remains in tight contact with the ceiling and completely hides the gap distortion behind.

FIG. 22 illustrates a cutaway end view of the components of the basic trim system installed in a typical retrogressive wall construction using an alternate Retainer Clip designed to be installed after wall finishes have been previously installed. This figure shows a typical wall construction of framing components containing a deflection track 6 attached to the ceiling or deck construction 3 with a concrete pin or screw 8 and vertical framing component 5. Also shown are a wall finish 4, caulk 7 and the embodiments substituting Retro-fit Retainer Clips 18 (for the standard Retainer Clip 1) and Trim Strip 2. Installation procedure is as follows: In spaces where the Retro-fit Retainer Clips are to be installed, existing caulk needs to be removed. The Retro-fit Retainer Clip 18 can then be installed between the top of the deflection track 6 and the ceiling 3 using a conventional framing screw 9 to hold it in place. After the Retro-fit Retainer Clips 18 are installed, the caulk needs to be reinstalled where removed. Trim Strip 2 components of the invention are then installed by forcing the horizontal portion of the Trim Strip 2 between the top of the Retro-fit Retainer Clip 18 and the ceiling construction 3 until it snaps into the Retro-fit Retainer Clip 18 hook. Once installed, the Trim Strip 2 is held tightly to the ceiling by the shape of and the tension exerted by the Retro-fit Retainer Clip 18. The relative position of the hooks on the Retro-fit Retainer Clips 18 and the Trim Strip 2 is engineered to provide a slight amount of lateral force on the face of the Trim Strip 2 which in conjunction with the resilient properties of the Trim Strip 2, holds it tight to the surface of the wall finish 4. The trim system would commonly be used on one or both sides of the framing in normal construction.

Figure 23:
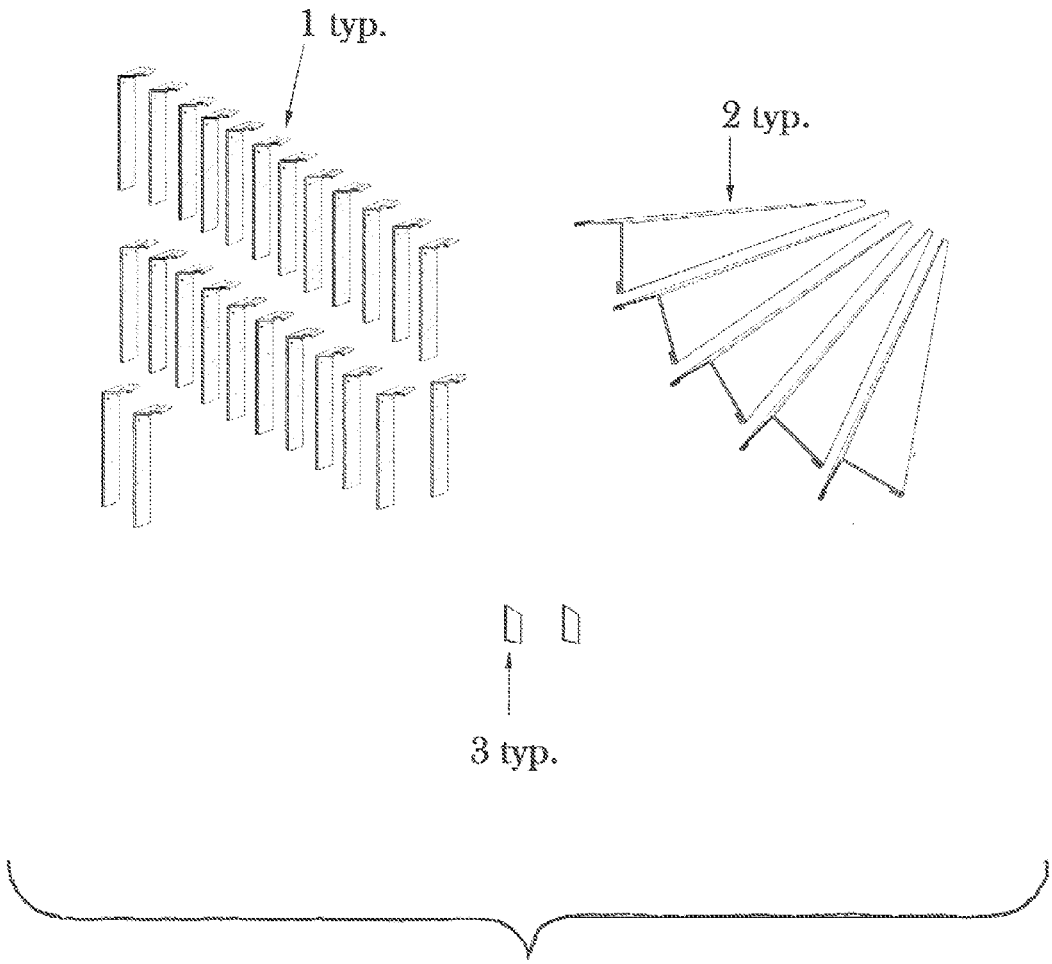
FIG. 23 illustrates the basic components of a trim kit for a typical room.

FIG. 23 illustrates the basic components of a self-adjusting trim kit for a typical room. This kit could have twenty five pieces of the Retainer Clips 1, five pieces of the Trim Strip 2 and two pieces of Joint Tab 10. Typically, several Retainer Clips would be supplied for each Trim Strip. When selecting the correct kit for the intended room, the end user would need to select the kit sized for the wall finish to be installed. For example: If the wall finish to be used is ⅝" thick, the Retainer Clips 1 would need to be sized for the ⅝" wall finish and the end user would need to select the kit containing the ⅝" sized Retainer Clips. If the wall finish to be used is 1¼" thick, the end user would have to select a kit containing the 1¼" sized Retainer Clips. Every self-adjusting trim kit would contain the standard Trim Strip 2 and the standard Joint Tabs 10.

Figure 24:
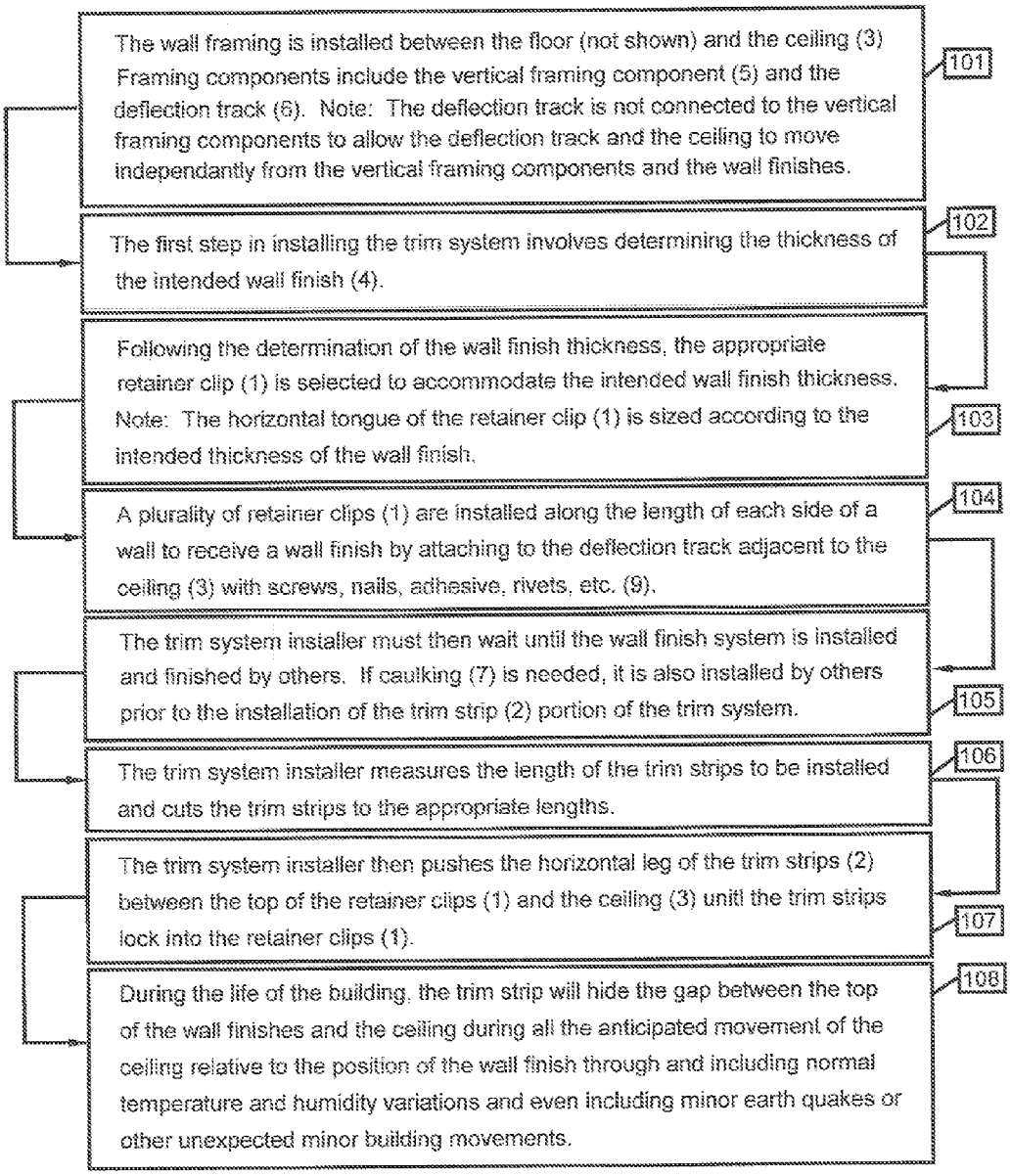
FIG. 24 illustrates the construction process of building a wall which incorporates the trim system during construction.

FIG. 24 illustrates the steps during construction of a typical wall with the trim system installation incorporated into the final construction of the wall. In most cases, the same installation company would install the framing, wall finishes and the trim system. However, separate operations are usually performed by separate installation crews within the company.

In step 101 the wall partition framing is installed between the floor (not shown) and the ceiling 3. The framing components include the vertical framing components 5 and the deflection track 6. Note that the vertical framing components 5 are not attached to the deflection track 6. Deflection track is attached to the flexing ceiling with fasteners 8 such as pins or screws. Installation of the trim system commences after step 101.

In step 102 the first step in installing the trim system involves determining the thickness of the intended wall finish 4. In step 103 following the determination of the wall finish thickness, the appropriate Retainer Clip 1 is selected to accommodate the intended wall finish thickness. A Retainer Clip 1 is chosen having a horizontal tongue sized according to the intended thickness of the wall finish. In step 104, a plurality of Retainer Clips 1 are installed along the length of each side of a wall to receive a wall finish by attaching to the deflection track adjacent to the ceiling 3 with screws, nails, adhesive, rivets, etc. 9. In step 105 the trim system installer must then wait until the wall finish system is installed and finished by others. If caulking 7 is needed, it is also installed by others prior to the installation of the Trim Strip 2 portion of the trim system. In step 106 the trim system installer measures the length of the Trim Strips to be installed and cuts the Trim Strips to the appropriate lengths. In step 107 the trim system installer then pushes the horizontal leg of the Trim Strips 2 between the top of the Retainer Clips 1 and the ceiling 3 until the trim strips lock into the Retainer Clips 1.

During the life of the building, in step 108, the Trim Strip will hide the gap between the top of the wall finishes and the ceiling during all the anticipated movement of the ceiling relative to the position of the wall finish through and including normal temperature and humidity variations and even including minor earthquakes or other unexpected minor building movements.

Any letter designations such as (a) or (b) etc. used to label steps of any of the method claims herein are step headers applied for reading convenience and are not to be used in interpreting an order or process sequence of claimed method steps. Any method claims that recite a particular order or process sequence will do so using the words of their text, not the letter designations.

Unless stated otherwise, terms such as "first" and "second" are used to arbitrarily distinguish between the elements such terms describe. Thus, these terms are not necessarily intended to indicate temporal or other prioritization of such elements.

Any trademarks listed herein are the property of their respective owners, and reference herein to such trademarks is generally intended to indicate the source of a particular product or service.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure.

What is claimed is:

1. In a construction comprising a dynamically varying gap between a wall finish and a ceiling moving relative thereto, wherein a deflection component provides a slip joint coupling between the ceiling and a vertical framing component, and wherein the wall finish is attached to a surface of the vertical framing component, the improvement comprising a retainer clip for holding a trim strip over the dynamically varying gap, the retainer clip comprising an L-shaped member comprising a vertical back portion and a horizontal projecting tongue formed of one piece of a resilient material, wherein the vertical back portion is fixedly anchored to a vertical side of the deflection component and wherein the horizontal projecting tongue comprises a first interlocking portion at a top near the ceiling formed to lock with a corresponding second interlocking portion of the trim strip so that the trim strip is pressed tight against a surface of the wall finish and a resiliency of the resilient material of the horizontal projecting tongue presses the trim strip tight against a surface of the ceiling to conceal the dynamically varying gap.

2. In a construction according to claim 1, wherein the horizontal tongue of the retainer clip has a length corresponding to a thickness of the wall finish.

3. In a construction according to claim 1, wherein a width of the retainer clip is significantly narrower than a width of the trim strip.

4. In a construction according to claim 1, wherein the resilient material is resilient metal.

5. In a construction according to claim 1, further comprising a kit, comprising at least one of said trim strip; and a plurality of said retainer clips.

6. In a construction according to claim 5, wherein the horizontal tongue of the retainer clip has a length corresponding to a thickness of the wall finish.

7. In a construction according to claim 5, wherein the kit further comprising at least one joint tab (10) for securing adjacent trim strips to one another when deployed against a finished wall.

8. In a construction according to claim 5, wherein a width of each retainer clip is significantly narrower than a width of the trim strip.

9. In a construction according to claim 5, wherein the kit comprises one retainer clip for each several feet of trim strip.

10. In a construction according to claim 5, wherein the retainer clip and the trim strip are each formed from one piece of the resilient material.

11. In a construction according to claim 1, wherein the deflection component is selected from the group consisting of a deflection track and a deflection angle.

12. In a construction according to claim 1, wherein the first interlocking portion of the horizontal projecting tongue of the retainer clip comprises an indent hook; and wherein the second interlocking portion of the trim strip comprises a folded tip on a horizontal part that rests on the indent hook.

13. In a construction comprising a dynamically varying gap between a wall finish and a ceiling moving relative thereto, wherein a deflection component provides a slip joint coupling between the ceiling and a vertical framing component, and wherein the wall finish is attached to a surface of the vertical framing component, the improvement comprising a retainer clip comprising an L-shaped member comprising a vertical back portion and a resilient horizontal projecting tongue formed of one piece of resilient material, and wherein the vertical back portion is fixedly anchored to a vertical side of the deflection component; and a trim strip for interlocking with the retainer clip to hold the trim strip over and conceal the dynamically varying gap, the trim strip comprising an elongated member formed of a resilient material with an L-shape in cross section and comprising a horizontal top portion and a face portion, wherein the horizontal top portion has an interlocking portion to lock with corresponding interlocking portions of the resilient horizontal projecting tongues of a plurality of the retainer clips so that the resilient horizontal projecting tongues of the retainer clips press the horizontal top portion of the trim strip tight against a surface of the ceiling and a resiliency of the resilient material of the trim strip presses a bottom of the face portion of the trim strip tight against a surface of the wall finish to conceal the dynamically varying gap.

14. In a construction according to claim 13, wherein a width of the trim strip is significantly wider than a width of each of the plurality of retainer clips.

15. In a construction according to claim 13, wherein the trim strip is formed from one piece of the resilient material.

16. In a construction according to claim 13, wherein the deflection component is selected from the group consisting of a deflection track and a deflection angle.

17. In a construction according to claim 13, wherein the interlocking portion of the horizontal projecting tongue of the retainer clip comprises an indent hook; and wherein the interlocking portion of the trim strip comprises a folded tip on a horizontal part that rests on the indent hook.

18. A method of installing a trim strip over a dynamically varying gap between a wall finish and a ceiling moving relative thereto, wherein a deflection component provides a slip joint coupling between the ceiling and a vertical framing component, and wherein the wall finish is attached to a surface of the vertical framing component, the method comprising the steps of:

(a) obtaining a retainer clip comprising an L-shaped member comprising a vertical back portion and a horizontal projecting tongue formed of one piece of a resilient material;

(b) securing the retainer clip wherein the vertical back portion is fixedly anchored to a vertical side of the deflection component and wherein the horizontal projecting tongue comprises a first interlocking portion at a top near the ceiling; and (c) obtaining and installing the trim strip comprising a second interlocking portion to couple and lock with corresponding of the first interlocking portion so that the trim strip is anchored over the dynamically varying gap with respective longitudinal sides of the trim strip pressed tight against the wall finish and a resiliency of the resilient material of the horizontal projecting tongue presses the trim strip tight against the ceiling to conceal the dynamically varying gap.

19. A method according to claim 18, wherein the deflection component is selected from the group consisting of a deflection track and a deflection angle.

20. A method according to claim 18, wherein the first interlocking portion of the horizontal projecting tongue of the retainer clip comprises an indent hook; and wherein the second interlocking portion of the trim strip comprises a folded tip on a horizontal part that rests on the indent hook.

* * * * *